US007180243B2

(12) United States Patent
Secheresse et al.

(10) Patent No.: US 7,180,243 B2
(45) Date of Patent: Feb. 20, 2007

(54) PLASMA ACCELERATOR WITH CLOSED ELECTRON DRIFT

(75) Inventors: Olivier Secheresse, La Ferte Alais (FR); Antonina Bougrova, Moscow (RU); Alexei Morozov, Moscow (RU)

(73) Assignee: SNECMA Moteurs, Paris (FR)

( * ) Notice: Subject to any disclaimer, the term of this patent is extended or adjusted under 35 U.S.C. 154(b) by 413 days.

(21) Appl. No.: 10/887,236

(22) Filed: Jul. 8, 2004

(65) Prior Publication Data

US 2005/0035731 A1 Feb. 17, 2005

(30) Foreign Application Priority Data

Jul. 9, 2003 (FR) ..... 03 08384

(51) Int. Cl.
*H01J 7/24* (2006.01)

(52) U.S. Cl. ..... 315/111.61; 315/111.21; 315/111.41; 315/111.51

(58) Field of Classification Search ..... 315/111.01–111.91; 118/723; 156/345; 250/251, 250/423

See application file for complete search history.

(56) References Cited

U.S. PATENT DOCUMENTS

| | | | | |
|---|---|---|---|---|
| 3,935,503 | A * | 1/1976 | Ress | 315/111.61 |
| 5,218,271 | A * | 6/1993 | Egorov et al. | 315/111.61 |
| 5,763,989 | A | 6/1998 | Kaufman | 313/361.1 |
| 6,215,124 | B1 | 4/2001 | King | 250/423 |
| 6,331,701 | B1 * | 12/2001 | Chen et al. | 250/251 |
| 6,825,618 | B2 * | 11/2004 | Pu et al. | 315/111.51 |
| 6,850,012 | B2 * | 2/2005 | Edamura et al. | 315/111.51 |
| 2003/0057845 | A1 * | 3/2003 | Edamura et al. | 315/111.21 |
| 2004/0183452 | A1 * | 9/2004 | Kornfeld et al. | 315/111.61 |
| 2004/0222745 | A1 * | 11/2004 | Chistyakov | 315/111.41 |
| 2006/0152162 | A1 * | 7/2006 | Madocks | 315/111.21 |

FOREIGN PATENT DOCUMENTS

| | | |
|---|---|---|
| FR | 2 693 770 | 1/1994 |

* cited by examiner

*Primary Examiner*—Thuy V. Tran
*Assistant Examiner*—Tung Le
(74) *Attorney, Agent, or Firm*—Weingarten, Schurgin, Gagnebin & Lebovici LLP

(57) ABSTRACT

The closed electron drift plasma accelerator comprises an annular ionization chamber, an acceleration chamber on the same axis as the ionization chamber, an annular anode, a hollow cathode, a first DC voltage source, an annular gas manifold, a magnetic circuit, and magnetic field generators. A coaxial annular coil is placed in the cavity of the ionization chamber, is provided with bias conductive cladding connected, together with the electrically-conductive material of the inside faces of the walls of the ionization chamber, to the positive pole of a second voltage source whose negative pole is connected to the anode, and constitutes an additional magnetic field generator which, together with the other magnetic field generators, forms a magnetic field having a magnetic line of force with an "X" point corresponding to a magnetic field zero situated between the coaxial annular coil and the anode.

19 Claims, 3 Drawing Sheets

PLASMA ACCELERATOR WITH CLOSED ELECTRON DRIFT

This application claims priority to a French application No. 03 08384 filed Jul. 9, 2003.

FIELD OF THE INVENTION

The present invention relates to plasma accelerators with closed electron drift, which accelerators constitute plasma ion sources that can be used in particular as steady plasma thrusters in space, and also in other technical fields, for example in treating mechanical parts with ions.

PRIOR ART

Ion sources are already known that are constituted by two-stage systems serving to perform electrostatic acceleration of the ion flux.

An example of such an ion source is described in patent document WO 01/93293. In that document, an ion source comprises a cathode chamber with a gas manifold, while a hollow anode forms an anode chamber connected to the cathode chamber via the outlet orifice that is formed through the wall thereof. An electrostatic system serves to extract ions with the electrically-insulated emission electrode placed in the outlet orifice of the cathode chamber. A magnetic system establishes a magnetic field in the cathode and anode chambers, the field having an induction vector that is mainly in the axial direction. The cathode chamber gas manifold is also used as an ignition electrode connected to the hollow anode. An additional electrode that is electrically-insulated relative to the hollow anode and to the cathode chamber is installed in the outlet orifice of the cathode chamber and presents an orifice of diameter that is much smaller than the maximum inside diameter of the hollow cathode. Ionization takes place in the anode and cathode chambers with a magnetic field that is essentially longitudinal, with the extraction and acceleration of the ions being produced by the electrostatic system. Such ion sources operate in the low current density range ($j_i$<2 milliamps per square centimeter (mA/cm$^2$)) and they are effective only with high acceleration voltages (U>1000 volts (V)), which limits their applications.

Amongst sources in which ion acceleration is due to electromagnetic sources, mention can be made of the plasma accelerator of the KCPU type: a coaxial, quasi-steady plasma accelerator (e.g. as described in the article by A. U. Volochko et al. entitled "Study of the two-stage coaxial quasi-steady plasma accelerator (KCPU) with support electrodes" published in the journal of the USSR Academy of Sciences, Plasma Physics, Vol. 16, 2nd edition, M. "Science" in February 1990.

Fixed to the (rear) edge flange and isolated from the flange, the KCPU comprises an anode group, a cathode group, and an inlet ion unit. The anode and cathode groups are separated by means of an annular disk insulator. The anode group contains a cylindrical support anode made in the form of a "squirrel cage", fixed to the transition flange. Around the anode there is additionally established a cylindrical dielectric screen contributing to increasing the concentration of gas and plasma in the space outside the anode. The cathode group is installed inside the squirrel cage of the anode group and comprises two superposed copper tubes having blades fixed at their ends forming an ellipsoid of rotation. On the inside tube there are fixed 128 points, conically-sharpened current sources, forming eight rows in longitudinal section and interposed between the blades in intervals, reproducing the shape of the cathode. The ion unit is constituted by four inlet ion chambers connected to the active gas source, and introduced into the acceleration channel of the KCPU via orifices in the edge flange that are symmetrical about the axis of the system. Each chamber contains an anode in the form of a solid cylinder and a tapering solid cathode.

The KCPU accelerator is thus designed as a two-stage system. In the first stage of the accelerator, the active substance is ionized and pre-accelerated up to a speed of:

$$v \approx 0.1 v_m$$

where:

$v_m$=the flow speed for plasma accelerators having their own magnetic field;

$$v_m = \theta \frac{I^2}{mc^2}$$

where:

θ=a constant coefficient;

m=the mass flow rate of the active substance c=the speed of light

I=the current flowing via the volume of plasma between the two coaxial electrodes.

Final acceleration of the plasma takes place in the second stage.

In the KCPU with a discharge current of about 500 kiloamps (kA) and with discharge voltages of about 10 kilovolts (kV), plasma fluxes of 0.2 m.c have been obtained with hydrogen ions having energy of about 1 kilo electron volts (keV). The KCPU accelerator possesses high power enabling streams of particles of great energy to be created. It should be observed that in that accelerator there is practically no upper limit on power and energy.

That type of plasma accelerator is electromagnetic, the plasma being accelerated by magnetomotive force of density:

$$f_M = \frac{1}{c}(j \times H)$$

where:

c=speed of light j=current density

H=the magnetic field specific to the current I flowing through the volume of plasma.

The magnetic field in the KCPU is formed by the currents flowing through the volume of plasma (because of the presence of coaxial electrodes) and constitutes the specific magnetic field. It follows that that type of accelerator can operate only at high power. That is why, at present, its use as an engine in space, for example, would not appear to be possible.

Document FR 2 693 770 discloses a plasma accelerator with closed electron drift in which considerable improvements have been provided concerning the conditions under which the active substance is ionized and the configuration of the magnetic field throughout the volume of the coaxial channel. Such a plasma accelerator comprises an ionizing or stilling chamber and a discharge chamber with an open-outlet coaxial channel for ionization and acceleration. A hollow gas discharge cathode is placed beside the open outlet of the coaxial channel. An annular anode is placed at the inlet to the coaxial channel. An annular gas manifold is installed in the stilling chamber without closing off the access to the coaxial channel. The discharge and stilling chambers are formed by elements of the magnetic system of the accelerator, which comprises a pair of magnetic poles, a magnetic circuit, and a magnetic field generator. The magnetic poles form one end of the accelerator beside the open outlet of the annular channel. One of the magnetic poles is on the outside and the other on the inside, and consequently they define the inside and the outside of the discharge chamber. Another end of the accelerator, beside the stilling chamber, is formed by a portion of magnetic circuit which is connected to the magnetic poles. A central cylindrical mandrel and secondary support elements disposed uniformly around the chambers thus serve to interconnect the ends of the accelerator. A first magnetic field generator is placed between the stilling chamber and the outer magnetic pole around the acceleration chamber, a second magnetic field generator is located on the central cylindrical mandrel in the vicinity of the inside magnetic pole, and a third magnetic field generator is also disposed on the central cylindrical mandrel in the zone in which the annular anode is located, and is thus closer to the stilling chamber.

Thus, because of the presence of the ionization or stilling chamber, the zone in which the active gas is ionized does not coincide with the acceleration zone. This is due to the fact that the annular gas manifold injects the active gas directly in front of the anode. The three-generator magnetic system ensures that a quasi-radial magnetic field is formed in the annular channel, having a gradient that is characterized by maximum induction at the outlet from the channel. The magnetic force lines are directed perpendicularly to the axis of symmetry of the annular channel in the outlet zone, and these lines slope slightly in the zone of the channel that is close to the anode. Ionization of the active gas is ensured close to the anode before it reaches the annular channel. This makes it possible to increase the efficiency of the plasma engine up to the range 60% to 70% and to reduce the angle of divergence of the ion beam to the range 10% to 15%.

Nevertheless, in such an accelerator, the degree to which the active gas in the stilling zone is ionized is not very great, and this has been confirmed by experiment.

OBJECT AND BRIEF SUMMARY OF THE INVENTION

An object of the invention is to remedy the drawback of prior art plasma accelerators, and it seeks in particular to improve the efficiency with which the active gas is ionized.

The invention also seeks to make it possible to use a variety of active substances with high yield, to reduce significantly the angle of divergence of the ion beam, to reduce the level of noise associated with the process of accelerating ions, to increase yield while reducing losses of electric current at the walls, to increase lifetime by reducing the intensities of abnormal ion and electron erosion, and to enlarge the working range in terms of flow rate (flux) and specific impulse.

These objects are achieved by a closed electron drift accelerator comprising:

a) an annular ionization chamber defined by walls of electrically insulating material, having inside faces covered in an electrically-conductive material;

b) an acceleration chamber formed by an annular acceleration channel of insulating material which is on the same axis as the ionization chamber, having an outlet that is open in a downstream direction and having an upstream inlet communicating with the ionization chamber;

c) an annular anode placed at the downstream end of the ionization chamber in the vicinity of the upstream inlet of the acceleration channel;

d) a hollow cathode disposed in the vicinity of the downstream outlet of the acceleration channel, and outside it;

e) a first DC voltage source having its negative pole connected to the cathode and its positive pole connected to the anode;

f) an annular gas manifold disposed in the vicinity of the end wall constituting the upstream portion of the ionization chamber;

g) a magnetic circuit comprising at least a central cylindrical mandrel, inner and outer magnetic poles defining the open downstream outlet of the acceleration channel, and a rear end wall which forms the upstream end of the ionization chamber; and h) magnetic field generator means comprising at least a first magnetic field generator disposed around the acceleration chamber between the outer magnetic pole and the ionization chamber, a second magnetic field generator disposed around the central cylindrical mandrel between the inner magnetic pole and the upstream inlet to the acceleration channel situated beside the ionization chamber, and a third magnetic field generator disposed around the central cylindrical mandrel between the second magnetic field generator and the upstream end of the ionization chamber;

the accelerator further comprising a coaxial annular coil which is disposed inside the cavity of the ionization chamber, which is provided with biased conductive cladding connected together with the electrically-conductive material of the inside faces of the walls of the ionization chamber to the positive pole of a second voltage source whose negative pole is connected to the anode, and which constitutes a fourth magnetic field generator which, together with the other magnetic field generators, forms a magnetic field having a magnetic line of force that includes an "X" point corresponding to a magnetic field zero situated between said coaxial annular coil and the anode.

The plasma accelerator of the invention thus presents a low level of noise with flux that is well localized because a coil fed with electric current is inserted into the stilling zone of the ionization chamber, delivering a magnetic field which, in combination with that of the other magnetic field sources, produces a particular configuration containing a magnetic force line referred to as a separation or separating line having an X point with a magnetic field zero. Because of these characteristics, the acceleration channel of the plasma accelerator can receive a well-formed ion current, making use of the phenomenon of equipotentialization of the magnetic force lines and thereby creating an acceleration potential difference. The zone of the X point with a magnetic field zero represents a trap for ions which form along the separating line.

Advantageously, the magnetic field generator means include a fifth magnetic field generator disposed in the vicinity of the annular gas manifold.

The magnetic circuit may further include secondary ferromagnetic support elements distributed around the ionization and acceleration chambers and connecting the rear magnetic end wall to the outer magnetic pole.

In which case, and preferably, the magnetic field generator means further include a sixth magnetic field generator comprising components disposed around said secondary ferromagnetic support elements.

The magnetic field generator means may comprise electromagnetic coils, but they may also comprise at least in part permanent magnets.

The ionization chamber presents a dimension in the radial direction that is greater than that of the acceleration channel of insulating material.

According to a particular characteristic, the coaxial annular coil and its biased conductive cladding are mounted using fixing elements connected rigidly to the ionization chamber.

Preferably, the annular anode is mounted with radial clearance relative to the wall of the acceleration channel.

The annular anode is connected via an electricity feed line directly to the positive pole of the first DC source without being mechanically or electrically connected to the annular gas manifold or to the electrically-conductive material of the internal parts of the walls of the ionization chamber other than via the second DC voltage source.

By way of example, the second voltage source applies a positive voltage to the conductive cladding of the coaxial annular coil having a magnitude of several tens of volts relative to the anode.

Preferably, the second voltage source applies a potential to the electrically-conductive material of the inside faces of the walls of the annular ionization chamber having a magnitude of about 20 V to 40 V relative to the anode.

The magnetic field generator means are adapted so that the potential of the magnetic line of force having an "X" point corresponding to a magnetic field zero is close to the potential of the anode.

In an advantageous embodiment, the second magnetic field generator presents first and second zones of different diameters, the first zone situated in the vicinity of the anode presenting a diameter greater than that of the second zone situated in the vicinity of the ionization chamber.

In a particular embodiment, the distance between the conductive cladding of the coaxial annular coil and the walls of the ionization chamber is greater than or equal to about 20 millimeters (mm).

The plasma accelerator may be applied to a plasma space engine constituting an electric reaction thruster for a satellite, or other spacecraft.

The plasma accelerator of the invention may also be applied as a source of ions for applying ion treatment to mechanical parts.

BRIEF DESCRIPTION OF THE DRAWINGS

Other characteristics and advantages of the invention appear from the following description of particular embodiments given as examples and with reference to the accompanying drawings, in which.

DETAILED DESCRIPTION OF PARTICULAR EMBODIMENTS

Figure 3:
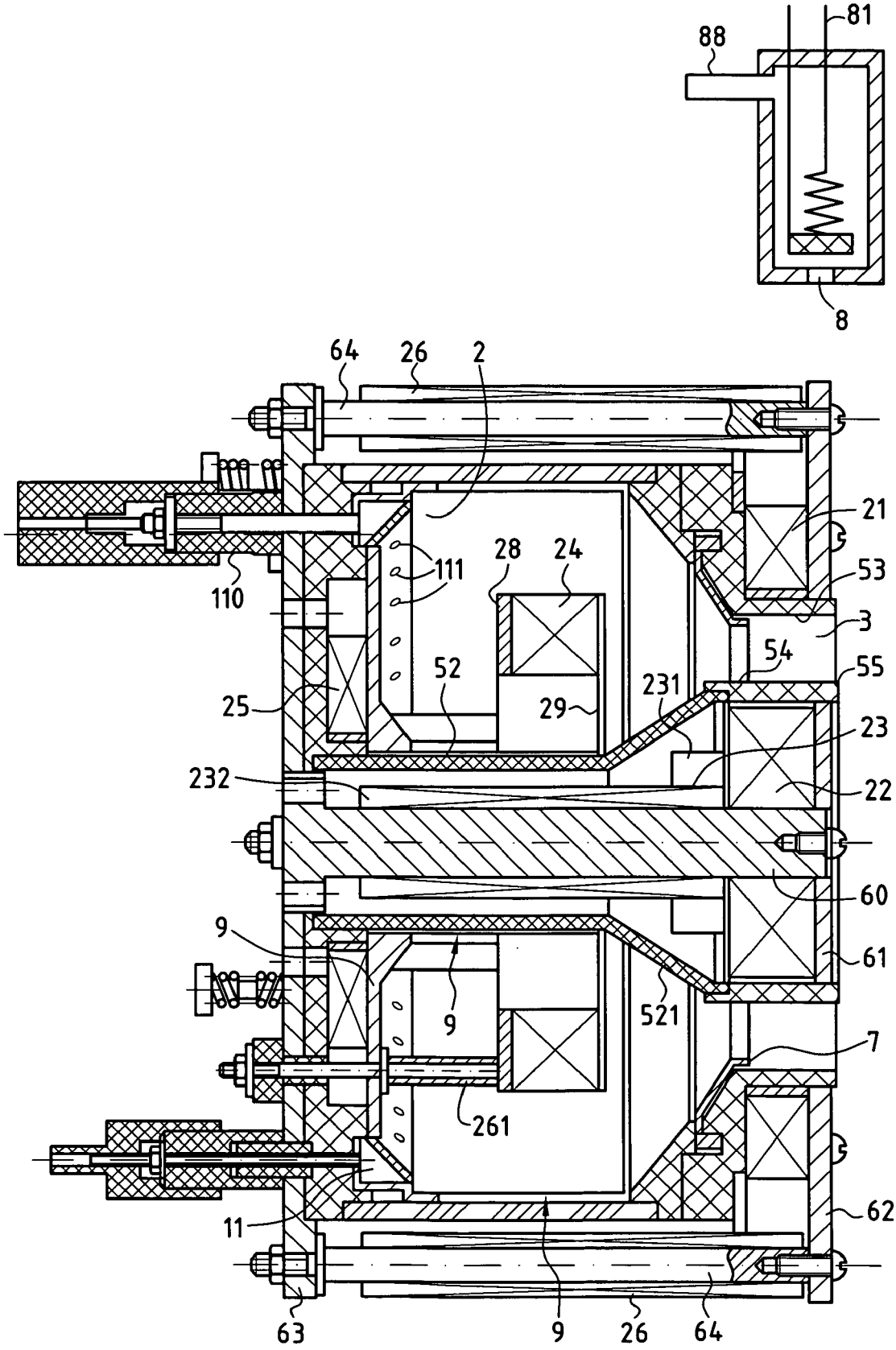
FIG. 3 is a longitudinal axial section of an example of a plasma accelerator of the invention.

FIG. 3 shows an example of a plasma accelerator in accordance with the invention.

Such a closed electron drift plasma accelerator comprises a first chamber 2 defined by walls 52 made of electrically-insulating material having inside faces covered in a conductive material 9. This first chamber 2 constitutes an ionizing chamber or stilling chamber.

A second chamber 3 referred to as an acceleration chamber comprises an annular acceleration channel 53 of electrically-insulating material with an outlet 55 that is open in the downstream direction. The upstream portion 54 of the acceleration channel 53 communicates with the cavity of the ionization chamber 2 which lies on the same axis as the acceleration chamber 3.

Figure 2:
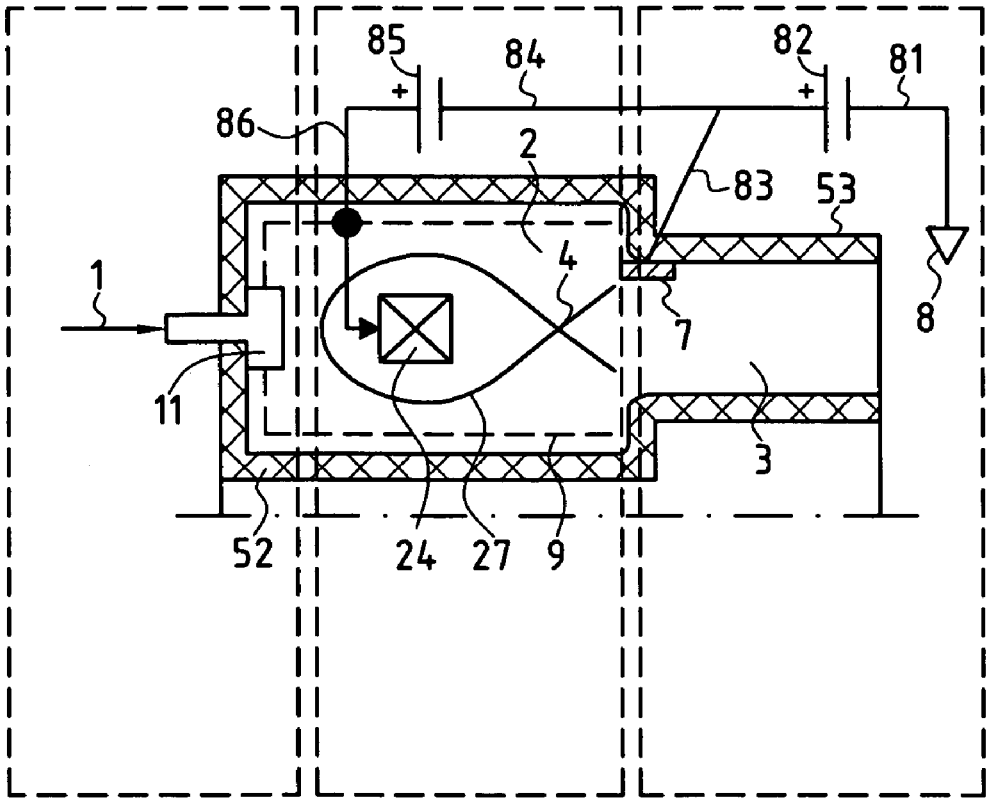
FIG. 2 is an outline diagram in longitudinal axial half-section of an example of a plasma accelerator of the invention, showing the electrical circuit associated therewith to operate the accelerator.

A hollow gas discharge cathode 8 is located outside the acceleration channel 53 in the vicinity of its outlet 55. Reference 81 designates the line electrically connecting the cathode to the negative pole of a first direct current (DC) voltage source 82 (FIG. 2). Reference 88 designates the supply of gas to the hollow cathode 8.

An annular anode 7 is situated at the downstream end of the ionization chamber 2 close to the upstream inlet 54 of the acceleration channel 53 which constitutes the acceleration chamber 3.

As shown in FIG. 2, the cathode 8 and the anode 7 are connected respectively to the negative pole and to the positive pole of the DC voltage source 82, thereby forming the electricity feed circuit. The anode 7 is itself insulated from the conductive material 9 of the walls of the ionization chamber 2.

An annular gas manifold 11 is disposed in the cavity of the ionization chamber 2 without closing off the inlet 54 to the acceleration channel 53. The gas manifold is placed at the upstream end of the ionization chamber 2. The cathode 8 and the gas manifold 11 are connected by respective lines 88 and 110 to sources of gas to be ionized which may be independent or common. The gas introduced into the annular gas manifold 11 by the line 110 is delivered into the stilling chamber 2 via orifices 111 that are distributed around the manifold 11.

The ionization or stilling chamber 2 is of a dimension in the radial direction that is greater than that of the acceleration chamber 3 and it may present any frustoconical profile in its downstream portion 521 opening out into the inlet 54 of the acceleration channel 53.

The annular anode 7 may itself be frustoconical in shape.

The closed electron drift plasma accelerator includes a magnetic circuit and magnetic field generators.

The magnetic circuit comprises a central cylindrical mandrel 60, inner and outer magnetic poles 61 and 62 defining the downstream open outlet 55 of the acceleration channel 53 and a rear wall 63 forming the upstream end of the ionization chamber 2.

The magnetic circuit also comprises secondary ferromagnetic support elements 64 which may be distributed uniformly along generator lines of a cylinder around the ionization and acceleration chambers 2 and 3 and which serve to connect the rear magnetic wall 63 to the outer front magnetic pole 62. These secondary ferromagnetic support elements 64 may be in the form of individual rods as shown in FIG. 3, but they could equally well be united to form a cylindrical cage surrounding the ionization and acceleration chambers 2 and 3.

It should be observed that the inner magnetic pole 61 and the rear end wall 63 of the magnetic circuit could be made in the form of a single unit with the central cylindrical mandrel 60.

The magnetic field generator means comprise a first magnetic generator 21 disposed around the acceleration chamber 3 between the outer magnetic pole 62 and the ionization chamber 2. This first magnetic field generator 21 may comprise a shielded electromagnetic coil.

A second magnetic field generator 22 is disposed around the central cylindrical mandrel 60 between the inner magnetic pole 61 and the upstream inlet 54 of the acceleration channel 53 situated beside the ionization chamber 2. In the example described with reference to FIG. 3, this second magnetic field generator 22 likewise comprises an electromagnetic coil.

A third generator 23 is disposed between the second magnetic field generator 22 and the inlet to the stilling chamber 2 about the central cylindrical mandrel 60. Preferably, there are two zones of different diameters. The diameter of one portion 231 of this generator, which is surrounded by the acceleration channel 53, including the contiguous zone of the anode 7, is greater than that of another portion 232 of the generator disposed in the zone of the stilling chamber 2. The ratio of the diameters of these different portions 231 and 232 of the second magnetic field generator 23 is selected in such a manner that:

$$\frac{r_\delta}{r_k} = 0.3 \text{ to } 0.5$$

where:

$r_\delta$=the distance from the axis of symmetry to the wall of the stilling chamber; and $r_k$=the distance from the axis of symmetry of the channel to the outer wall of the outer channel.

The idea is to optimize the shape of the magnetic force line defining the entry of ionized plasma from the stilling chamber 2 into the acceleration channel 53 (i.e. to ensure that the magnetic force lines are spaced apart from the walls of the stilling chamber).

In the cavity of the stilling chamber 2, there is installed a coaxial central annular coil 24 located in biased cladding 28 which is connected via a line 86 to the DC voltage source 85 (FIG. 2) serving to define the potential of the cladding 28 of the turn of the coil 24 relative to the anode 7 (see FIG. 2), the voltage source 85 itself being connected to the positive pole of the voltage source 82 and to the anode 7 by a line 84. The coaxial turn 24 may be mounted by fixing elements connected rigidly to the stilling chamber 2 and insulated from the magnetic circuit. Thus, the turn 24 represents a fourth magnetic field generator. The dimensions of the stilling chamber 2 are selected depending on requirements in such a manner that the distance from the cladding 28 of the central turn 24 to the walls of the stilling chamber 2 constitutes about 16 Larmor radii. Given the temperature values of the electrons, the electron temperature for effectively ionizing the atoms of gas lies in the range 15 electron-volts (eV) −20 eV, and the value of the magnetic field on the separating line is H≈100 oersteds (Oe), the distance b from the cladding 28 of the central turn 24 to the walls of the stilling chamber 2 should therefore be b≧20 mm to 25 mm.

Finally, in order to obtain the optimum configuration for the magnetic force lines, it is possible to introduce first and second additional magnetic field generators 25, 26. It should be observed that the first additional magnetic field generator 25 is placed in the stilling chamber 2 in the vicinity of the annular manifold 11 and serves to shape the magnetic field close to the rear edge so as to keep the magnetic force lines away from the end wall of the chamber. Its position is defined by the position of the end wall 63 of the magnetic circuit by the following relationship:

$$L = Lpp - \Delta$$

where:

Lpp=the distance from the acceleration channel 53 to the rear end wall 63 of the magnetic circuit; and Δ=the thickness of the insulator providing insulation from the rear end wall 63 to the magnetic field generator 25, with Δ=2 mm to 3 mm.

The second additional magnetic field generator 26 represents all of the outer elements, each of which is placed around a secondary support element 64. This generator, in common with the other magnetic field generators, serves to position the magnetic field zero in the zone of the anode 7, the given gradient of H=100 oersteds per centimeter (Oe/cm) close to the sections, and the convex shape of the magnetic field lines close to the anode 7, as required for receiving the zero zone. It should be observed that the generator 26 can be made as a single toroidal coil around the engine, the outer support 64 of the magnetic circuit then itself being toroidal.

Figure 1:
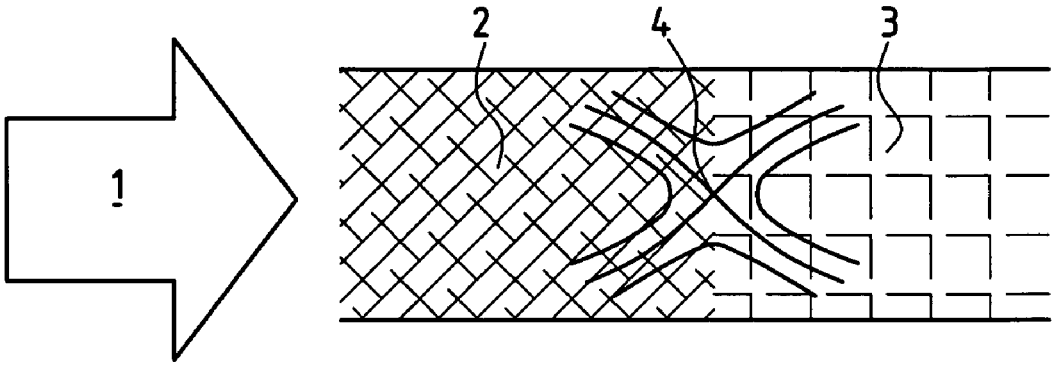
FIG. 1 is a diagram showing the basic concept of a two-stage plasma accelerator of the invention.
Figure 4:
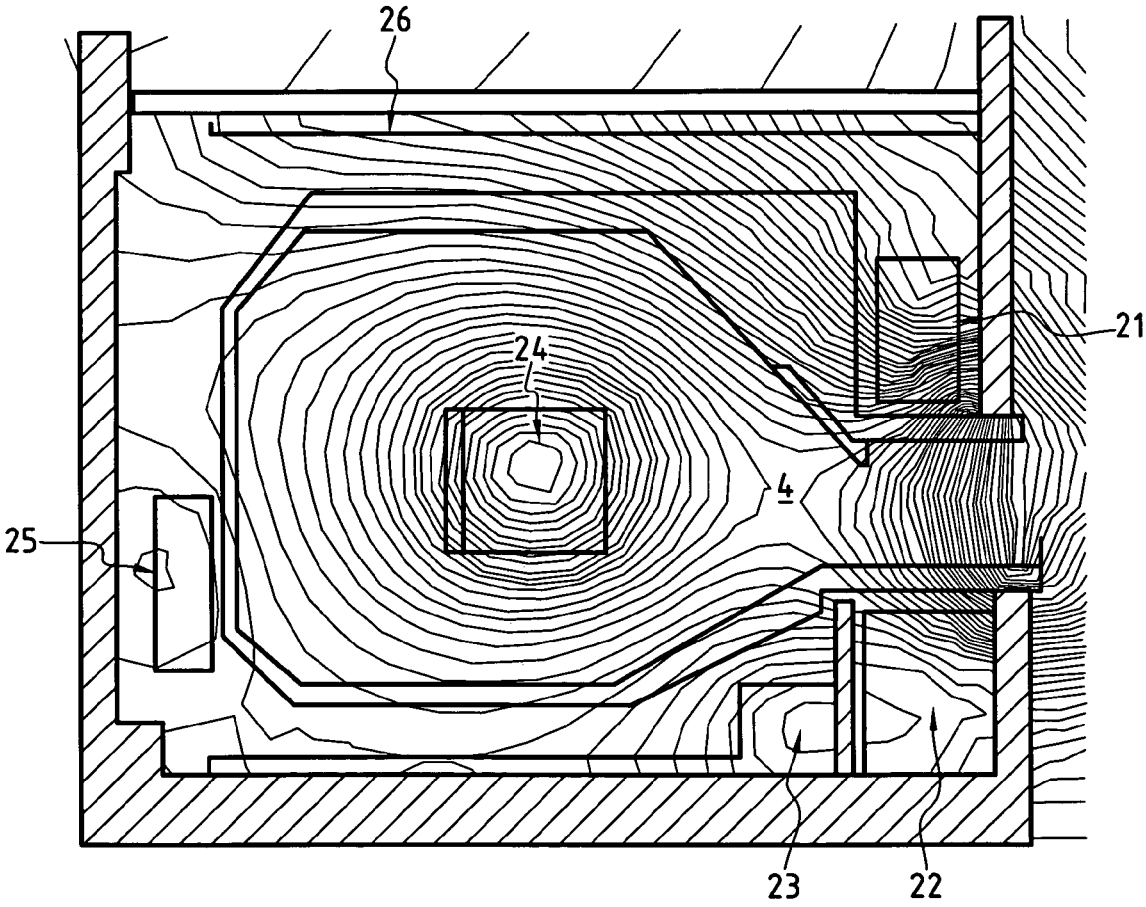
FIG. 4 shows the topography of the magnetic field obtained with an example of a plasma accelerator of the invention.

The structure of the magnetic system of the plasma accelerator makes it possible by an appropriate selection of inside diameters for the magnetic poles 61 and 62, of the corresponding disposition of the central turn 24 together with its current, and of the magnetic generators 21 to 26, to create the required configuration for the magnetic field (see FIGS. 1 and 4).

This configuration is characterized by a zero value for the field in the zone in which the anode 7 is positioned, by the angle between the branches of the separating lines 27 (FIG. 2) being equal to about 90°, and by the fact that these separating lines 27 pass through the walls of the channel at an angle of about 45° and meet in the zone of the anode 7, surrounding the central turn 24 without making contact with the walls of the stilling chamber 2. Close to the anode 7, the direction of the separating lines 27 creates a magnetic field having an angle of 45°, thereby satisfying the condition of separating the flow from the walls of the channel and focusing it on the middle of the area of the discharge chamber 3 with a given field gradient (not less than 100 Oe/cm) from the zero value in the zone where the anode 7 is positioned to its maximum value at the outlet from the annular channel 53.

All of the magnetic field generators 21 to 26 can be made using electromagnetic coils or permanent magnets providing they have a Curie point that remains greater than the active temperature of the plasma accelerator. It is possible to use a combination of electromagnetic coils and permanent magnets. If an embodiment is selected where the generators are made using electromagnetic coils, they may be powered using different sources of electricity and in a single direction, or using a single source of electricity (coils in series), in which case it is necessary to select the numbers of turns in each coil with care to ensure that the magnetic field has the desired shape.

The annular anode 7 is placed in the magnetic field zero zone, directly joining the inlet to the acceleration channel 53. However, in this case it is possible to re-spray the material of the insulating walls of the acceleration chamber 3 by the ion bombardment method, after which the non-conducive film will be formed on the surface of the anode 7. That is why, in order to maintain the active surface of the annular anode 7, it is better to locate it with radial clearance Δ relative to the wall of the acceleration channel 3. The value of this clearance should be selected to optimize conditions. Firstly, too much clearance must not be allowed to disturb the integrity of the flux nor to lead to erosion of the anode 7 by ion bombardment. Secondly, too little clearance should not interfere with the passage of current through the surface of the anode facing towards the acceleration channel. The clearance Δ can be adjusted by means of the mechanical connection of the anode, using rigid spacers. If these spacers are conductive, then the anode is electrically connected to the positive pole of the source of electricity by the electricity feed line.

In order to neutralize the ion flux leaving the acceleration channel 53, it is possible to install any type of gas discharge hollow cathode 8. In addition, the cathode 8 may be placed either on the side of the engine, or else in a variant inside the central mandrel and pointed towards the outside.

The plasma accelerator of the present invention operates as follows: the magnetic field of the desired shape is obtained by means of the magnetic field generators 21 to 26 in association with the other elements of the magnetic system. After dispensing the inert gas, e.g. xenon, to a pre-heated cathode 8 and to the annular gas manifold 11, a voltage is applied to the accelerator elements and the discharge then begins in the first and second chambers 3, 2.

The principles of the system are shown in the diagrams of FIGS. 1 and 2.

The stilling stage 2 comprises an equipotential wall 9 (referred to as SB), the annular turn 24 carrying its current, and the anode 7 which determines the potential in the zone of the magnetic field zero and which acts as a cathode for this stage. The fluid feed arrives at the rear face of this stage 2. The composition of the acceleration stage 3 is conventional. This stage comprises a dielectric channel 53 and a cathode 8 at the outlet from the generator.

The particular feature of the stilling stage 2 is the anode 7 which constitutes a stilling cathode. It provides discharge between the separating line 27 and the equipotential wall 9 (SB) of the stilling volume. The second particular feature is the "central turn" 24 with its current forming the annular conductor that creates the separator line and the trap for the ions that are formed.

The voltages applied to the elements of the first stage are as follows:

$$U\text{mix}=U_{SB}=U_A+\delta_{SB}$$

$$\text{Usep}=U_A$$

where:

$U_A$=potential of the anode 7

$U_{sep}$=potential of the separating line 27

Umix=potential of the mixyne 28 (biased surface of the central turn 24)

$U_{SB}$=potential of the wall 9

$\delta_{SB}$=≈20 V to 30 V.

Because of the equipotentialization of the magnetic force lines on potentials that are imposed, the separating line 27 whose potential is fixed by the anode 7 represents the bottom of a potential well in which the ions that are formed accumulate. They oscillate, falling on the barrier, either close to the mixyne 28, or else close to the equipotential wall 9 (SB). Since the distance between the frontiers of the oscillations increases going towards the "X" point 4, the ions head towards the channel 53, losing transverse speed and acquiring longitudinal speed (because of conservation of the transverse adiabatic invariant, $V^t \perp h$=constant, where h=the distance between the frontiers of the oscillations) heading towards the inlet 54 of the acceleration channel 53. Inside the channel 53 the magnetic configuration serves to provide a field that directs the ions. In addition, the value of the magnetic field H on the separating line 27 should be:

$$\left.\frac{H^2}{8\pi}\right| \geq (2n_e kT_e)$$

where:

$n_e$=concentration of electrons in the discharge k=Boltzmann's constant $T_e$=electron temperature.

In addition, taking possible diffusion into consideration, it is necessary for the distance $h_{m\text{-}c}$ between the mixyne 28 and the separating line 27, and the distance $h_{c\text{-}cb}$ between the separating line 27 and the buffer wall should be greater than $8\times\rho_e$, i.e. eight electron radii, and thus:

$$h_{M\text{-}C}=\theta_{MC}\rho_e\ \theta_{MC}\geqq 8$$

$$h_{C\text{-}Cb}=\theta_{C\text{-}Cb}\rho_e\ \theta_{C\text{-}Cb}\geqq 8$$

The ability to create a plasma that is fully ionized with low energy (5 eV to 15 eV) in the stilling stage 2 makes it possible to obtain an ionized flux in the acceleration channel 53 that has practically only one energy, thus enabling it to be well focused and spaced apart from the walls.

The acceleration stage 3 operates in conventional manner. The magnetic field increases towards its outlet and has a maximum in the outlet plane. The gradient of the magnetic field is 100 Oe/cm. The magnetic force lines are of convex shape towards the anode 7. It is the electric field which causes the ions to move. The electrons travel in the azimuth direction in the crossed electric and magnetic fields.

The possibility of creating an electric field that is convex towards the anode 7 and that focuses the ions into the middle of the acceleration channel 53 is linked with equipotentializing the magnetic force lines. This process is linked with the fact that for a plasma accelerator with closed circuit electron drift, the equation of motion of the electrons is as follows:

$$0=\nabla Pe+eE+1/c[V_eH];\ E=-\text{grad}\ \Phi$$

where:

∇Pe=the electron pressure gradient e=the charge of an electron

E=the magnitude of the magnetic field $V_e$=electron speed

H=magnitude of the magnetic field

Φ=electric field potential.

Integrating this equation along the magnetic line of force 27 gives the following formula:

$$\Phi^*(\gamma)=\Phi(\chi)-kT_e/e\cdot In\ n_e/n_e(\gamma)$$

where:

Φ*(γ)=the constant value of potential along the magnetic force line, referred to as the thermalized potential;

Φ(χ)=electrical potential;

$T_e$=electron temperature;

k=Boltzmann's constant;

$n_e$=concentration of electrons in the discharge;

$n_e(\gamma)$=characteristic of electron concentration on a given force line in the magnetic field (normalized value).

The above equation shows that the magnetic force lines are at equal potentials if $T_e \rightarrow 0$ or $n_e = n_e(\gamma)$. Providing these conditions are satisfied, it suffices to create magnetic force lines that are convex towards the anode 7, in order to obtain the desired shape for the equipotentials of the electric potential. Thus, in order to create a plasma accelerator having high operating performance, it is necessary to satisfy the following conditions:

Firstly, it is necessary to ensure that the densities of the ion fluxes close to the anode are uniform (and consequently that the densities of neutral particles are uniform), thereby reducing the influence of the component VPe on the process, and secondly it is necessary to ensure that the shape of the magnetic force lines is strongly convex towards the anode 7. To achieve this, it is very important to ensure the required focusing of ions in the ionization zone where their speed is slow.

The accelerator thus operates as a two-stage system. In the stilling stage 2, only one problem is solved: the substance is ionized as completely as possible, while the energy of the ions can be very low. The volume of the ionization zone has no limit and in practice it is possible to obtain complete ionization of the active substance and to prevent any neutral substance passing into the acceleration channel 53. Consequently, the amount of neutral substance ionized in the acceleration zone is reduced, and the operating range is increased both in flow rate and in specific impulse.

The requested profile for the magnetic field in the stilling chamber 2 and a channel close to the ideal configuration for the magnetic field has been achieved experimentally. The divergence of the ion beam was reduced to a value of about ±10°, or even ±3°, with yield being increased up to 65% to 70%, and, another important point, the working range of the engine was enlarged both in terms of thrust and in terms of specific impulse.

The technical advantages of the invention due to increasing the degree of ionization of the accelerated active substance are confirmed by the results of experiments. It has been possible to ionize the active gas to an extent that is considerably greater than that of existing devices in a four-pole system created by two coils carrying same-direction currents. Under such circumstances, the magnetic field zero zone is formed between the coils and is surrounded by the magnetic barrier. When a cathode is put into said zone and the coils have a positive potential applied thereto, discharge ignites and the plasma fills all of the space surrounding the separator line. In that system in accordance with the invention, with a source power of about 30 watts (W) ($U_p \leqq 200$ V, $J_p \leqq 160$ mA), and using xenon, the following characteristics were obtained:

M=2 milligrams (mg) per second;

$n_e \approx 10^{12}$ cm$^{-3}$;

at $T_e \approx 30$ eV and $\epsilon_i \approx 50$ eV;

where M=the flow rate of active substance;

$n_e$=electron concentration;

$T_e$=electron temperature;

$\epsilon_i$=mean ion energy.

This data is unique, since, in a steady discharge at low power, it was possible to obtain high electron temperature and a large concentration of electrons, regardless of the type of active gas used.

It has been possible to use a variety of active substances with high yields and having the following characteristics:

a) less expensive (Kr, Ar, $N_2$);

b) to be found in the atmospheres of planets ($CO_2$, $CH_4$, $NH_3$); and c) constituted by metal vapors (light metals Na, Mg, K, up to heavy metals Hg, Pb, Br).

What is claimed is:

1. A closed electron drift plasma accelerator comprising:

a) an annular ionization chamber defined by walls of electrically insulating material, having inside faces covered in an electrically-conductive material;

b) an acceleration chamber formed by an annular acceleration channel of insulating material which is on the same axis as the ionization chamber, having an outlet that is open in a downstream direction and having an upstream inlet communicating with the ionization chamber;

c) an annular anode placed at the downstream end of the ionization chamber in the vicinity of the upstream inlet of the acceleration channel;

d) a hollow cathode disposed in the vicinity of the downstream outlet of the acceleration channel, and outside it;

e) a first DC voltage source having its negative pole connected to the cathode and its positive pole connected to the anode;

f) an annular gas manifold disposed in the vicinity of the end wall constituting the upstream portion of the ionization chamber;

g) a magnetic circuit comprising at least a central cylindrical mandrel, inner and outer magnetic poles defining the open downstream outlet of the acceleration channel, and a rear end wall which forms the upstream end of the ionization chamber; and h) magnetic field generator means comprising at least a first magnetic field generator disposed around the acceleration chamber between the outer magnetic pole and the ionization chamber, a second magnetic field generator disposed around the central cylindrical mandrel between the inner magnetic pole and the upstream inlet to the acceleration channel situated beside the ionization chamber, and a third magnetic field generator disposed around the central cylindrical mandrel between the second magnetic field generator and the upstream end of the ionization chamber;

the accelerator further comprising a coaxial annular coil which is disposed inside the cavity of the ionization chamber, which is provided with biased conductive cladding connected together with the electrically-conductive material of the inside faces of the walls of the ionization chamber to the positive pole of a second voltage source whose negative pole is connected to the anode, and which constitutes a fourth magnetic field generator which, together with the other magnetic field generators, forms a magnetic field having a magnetic line of force that includes an "X" point corresponding to a magnetic field zero situated between said coaxial annular coil and the anode.

2. A plasma accelerator according to claim 1, wherein the magnetic field generator means include a fifth magnetic field generator disposed in the vicinity of the annular gas manifold.

3. A plasma accelerator according to claim 1, wherein the magnetic circuit further includes secondary ferromagnetic support elements distributed around the ionization and acceleration chambers and connecting the rear magnetic end wall to the outer magnetic pole.

4. A plasma accelerator according to claim 3, wherein the magnetic field generator means further include a sixth magnetic field generator comprising components disposed around said secondary ferromagnetic support elements.

5. A plasma accelerator according to claim 1, wherein the magnetic field generator means comprise electromagnetic coils.

6. A plasma accelerator according to claim 1, wherein the magnetic field generator means comprise, at least in part, permanent magnets.

7. A plasma accelerator according to claim 1, wherein the first magnetic field generator is shielded.

8. A plasma accelerator according to claim 1, wherein the ionization chamber presents a dimension in the radial direction that is greater than that of the acceleration channel of insulating material.

9. A plasma accelerator according to claim 1, wherein the coaxial annular coil and its biased conductive cladding are mounted using fixing elements connected rigidly to the ionization chamber.

10. A plasma accelerator according to claim 1, wherein the annular anode is mounted with radial clearance relative to the wall of the acceleration channel.

11. A plasma accelerator according to claim 1, wherein the annular anode is connected via an electricity feed line directly to the positive pole of the first DC source without being mechanically or electrically connected to the annular gas manifold or to the electrically-conductive material of the internal parts of the walls of the ionization chamber other than via the second DC voltage source.

12. A plasma accelerator according to claim 1, wherein the cathode is a hollow gas-discharge cathode.

13. A plasma accelerator according to claim 1, wherein the second voltage source applies a positive voltage to the conductive cladding of the coaxial annular coil having a magnitude of several tens of volts relative to the anode.

14. A plasma accelerator according to claim 1, wherein the second voltage source applies a potential to the electrically-conductive material of the inside faces of the walls of the annular ionization chamber having a magnitude of about 20 V to 40 V relative to the anode.

15. A plasma accelerator according to claim 1, wherein the magnetic field generator means are adapted so that the potential of the magnetic line of force having an "X" point corresponding to a magnetic field zero is close to the potential of the anode.

16. A plasma accelerator according to claim 1, wherein the second magnetic field generator presents first and second zones of different diameters, the first zone situated in the vicinity of the anode presenting a diameter greater than that of the second zone situated in the vicinity of the ionization chamber.

17. A plasma accelerator according to claim 1, wherein the distance between the conductive cladding of the coaxial annular coil and the walls of the ionization chamber is greater than or equal to about 20 mm.

18. A plasma accelerator according to claim 1, the accelerator being applied to a plasma space engine constituting an electric reaction thruster for a satellite.

19. A plasma accelerator according to claim 1, the accelerator being applied to an ion source for ion treatment of mechanical parts.

* * * * *